US011116686B2

(12) United States Patent
Kramer

(10) Patent No.: US 11,116,686 B2
(45) Date of Patent: Sep. 14, 2021

(54) METHODS FOR INDUCING FULL KNEE FLEXION

(71) Applicant: HealthMed Services, LLC, Bemidji, MN (US)

(72) Inventor: Daniel Gerard Kramer, Bemidji, MN (US)

(73) Assignee: HealthMed Services, LLC, Bemidji, MN (US)

( * ) Notice: Subject to any disclaimer, the term of this patent is extended or adjusted under 35 U.S.C. 154(b) by 233 days.

(21) Appl. No.: 16/179,067

(22) Filed: Nov. 2, 2018

(65) Prior Publication Data

US 2019/0142679 A1 May 16, 2019

Related U.S. Application Data

(60) Provisional application No. 62/586,103, filed on Nov. 14, 2017.

(51) Int. Cl.

| | |
|---|---|
| ***A61H 1/02*** | (2006.01) |
| ***A63B 1/00*** | (2006.01) |
| *A63B 21/00* | (2006.01) |

(52) U.S. Cl.

CPC ..... *A61H 1/024* (2013.01); *A63B 1/00* (2013.01); *A61H 2201/0192* (2013.01); (Continued)

(58) Field of Classification Search

CPC ..... A61H 1/024; A61H 2201/0192; A61H 2203/0437; A61H 2201/164; A61H 2201/1269; A61H 2201/1642; A61H 2203/0431; A61H 1/00; A61H 1/02; A61H 1/0237; A61H 2201/0157; A61H 2201/1253; A61H 2201/1261; A61H 2201/16; A61H 2205/10; A61H 2205/102; (Continued)

(56) References Cited

U.S. PATENT DOCUMENTS

| | | | |
|---|---|---|---|
| 2,855,199 | A | 10/1958 | Noland et al. |
| 4,304,401 | A | 12/1981 | Goodman |

(Continued)

OTHER PUBLICATIONS

Daniel F. LeBlanc: "KneeRite—Designed for Problematic Knee Conditions"; Massachusetts Medical, Device Development Center, 1 page; printed from the Internet on Oct. 29, 2018.

(Continued)

*Primary Examiner* — Quang D Thanh

(74) *Attorney, Agent, or Firm* — Hamre, Schumann, Mueller & Larson, P.C.

(57) ABSTRACT

A method for inducing knee flexion is described that includes securing a knee rehabilitation device to a leg, the rehabilitation device includes a frame with a handle on a proximal end, a pad piece on a distal end, and a strap between the proximal end and the distal end. The method further includes positioning the knee rehabilitation device on the person's leg such that the handle is above a knee on the leg, the pad piece is on an ankle of the leg, and the strap is located behind the person's leg between the knee and ankle. A first force is then applied to the handle in a first direction. The pad piece is actuated in response to the first force to move in a second direction which applies a second force to the ankle of the leg in a direction to cause flexion of the knee.

7 Claims, 5 Drawing Sheets

(52) U.S. Cl.
CPC ..... *A61H 2201/1269* (2013.01); *A61H 2201/164* (2013.01); *A61H 2201/1642* (2013.01); *A61H 2203/0431* (2013.01); *A61H 2203/0437* (2013.01); *A63B 21/4011* (2015.10)

(58) Field of Classification Search
CPC ..... A61H 2205/106; A61H 2205/108; A63B 1/00; A63B 21/4011; A63B 21/0023; A63B 21/00178; A63B 21/00181; A63B 21/068; A63B 2208/0238; A63B 21/4034; A63B 23/0494; A63B 2220/24; A63B 2225/09; A63B 2208/0233; A63B 21/4047; A63B 21/00185; A63B 23/03508; A63B 69/0057; A63B 23/0482; A63B 69/0062; A63B 21/159; A63B 2023/006; A63B 21/4035; A63B 2208/0247; A63B 21/00072
See application file for complete search history.

(56) References Cited

U.S. PATENT DOCUMENTS 5,236,333 A * 8/1993 Barba, Jr. ..... A61H 1/024 482/125
5,509,894 A 4/1996 Mason et al.
5,582,579 A 12/1996 Chism et al.
8,267,839 B1 * 9/2012 Bartolotta ..... A63B 21/4033 482/79
9,205,015 B2 12/2015 Guillen
9,254,403 B2 2/2016 Wertz et al.
9,498,399 B1 11/2016 Juntunen
9,669,249 B2 6/2017 Marti et al.
2004/0147380 A1 * 7/2004 Mattox ..... A63B 23/035 482/139
2009/0017995 A1 * 1/2009 Freiberg ..... A63B 23/03583 482/91
2011/0137215 A1 * 6/2011 LeBlanc ..... A61H 1/024 601/5
2014/0200490 A1 * 7/2014 Kie ..... A61H 1/024 601/5
2014/0207030 A1 * 7/2014 Hall ..... A61H 1/024 601/34
2015/0374572 A1 * 12/2015 Gilderman ..... A61H 1/024 601/5
2018/0250185 A1 * 9/2018 Briggs ..... A61H 1/024

OTHER PUBLICATIONS

"The Kneewell Instructions"; retrieved from the Internet; https://kneewell.com/how-to-operate.html on Oct. 29, 2018, 5 pages.
KNEEMD by Promotus; retrieved from the Internet, https://www.kneemd.co/, on Oct. 29, 2018, 7 pages.

* cited by examiner

METHODS FOR INDUCING FULL KNEE FLEXION

FIELD

Embodiments described herein relate to methods for inducing knee flexion.

BACKGROUND

The knee is a complex structure that joins the upper leg (or thigh or femur) and the lower leg (or tibia). Two joints form the knee: a tibiofemoral joint, which is a joint between the tibia and femur, and a patellofemoral joint, which is a joint between the femur and the patella. The two joints of the knee create a hinge joint that permits flexion and extension. Thus, achieving movement of the knee is of utmost importance following knee surgery or recovery from an injury.

While different products and techniques are available to assist with knee rehabilitation, many are cost restrictive and/or space restrictive. Rehabilitation devices for various therapies related to the knee include wraps, sleeves, electrotherapy, mechanical stimulators, lasers, temperature modulating devices.

Being able to flex (bend) the knee to its full ability is an important component of overall knee health and personal mobility. The health and function of the knee is an important component of the musculoskeletal function and can be compromised by injury, condition, and/or disease. Activity such as navigating stairs, getting into/out of vehicles, and general ambulation can be significantly limited by the inability to fully flex the knee.

Successful treatment of debilitating knee conditions include regaining knee flexion, in addition to other related aspects, such as muscle strengthening and managing pain and swelling. Regaining knee flexion after major knee surgery (including knee replacement) is a challenging part of the recovery process. Gaining knee flexion is paramount to a full recovery that is satisfying for patients. Failure to achieve an adequate amount of knee flexion may limit the function of the knee. Limited knee function as defined by the difficulty with navigating stairs and getting into/out of cars has been defined as a contributor to patient dissatisfaction with their outcome following surgery. This has been documented by a published article in the medical literature by Robert Bourne MD and colleagues in which 19% of 1703 patients surveyed responded that they were "not satisfied" with results after total knee replacement.

A successful recovery following knee surgery and/or knee replacement injury includes regaining knee flexion, muscle strengthening, and management of pain and swelling.

There are a number of techniques/devices/methods to assist the patient in regaining knee flexion following surgery. Devices range from the simple ankle strap with rope allowing a patient to pull the ankle towards the buttocks (thus bending the knee), to complex machines known as Continuous Passive Motion machines (CPMs), which are motorized exercisers that bend the knee back and forth, to leg braces with a hinge at the knee with a mechanism to lock the knee at a certain angle ("static splints") or with a mechanism such as a spring providing a continual force to bend the knee ("dynamic splints"). Many of these devices are not only complex but also expensive. Complex devices can be difficult for the patients to understand and use and this can lead to abandonment or non-compliance with the prescribed device. Complex devices such as a CPM machine or dynamic or static splint also require a fitting process by a technician. These devices often generate costs in excess of one thousand dollars, and are not always covered by insurance.

During recovery from knee replacement and other knee conditions, patients may fall behind in the ability to gain full knee flexion. In many cases by the time a patient is identified by a clinician with a "flexion contracture" (an inability to adequately bend the knee), the patient is already at risk for needing a second surgery to re-establish full knee flexion. These second surgeries are known as "manipulation" or alternatively called "examination under anesthesia", wherein the knee is forcefully bent to regain full flexion. As previously mentioned these are devastating complications increasing patient's risk of developing a permanent inability to flex the knee adequately. Along with that, related complications such as hypersensitivity to pain in and around the knee joint diagnosed clinically as "complex regional pain syndrome" can result. These are examples of devastating failures of recovery from knee surgery and conditions.

With the ongoing significance of the problem of regaining full knee flexion, there are many examples of previously patented devices, all much different from the rehabilitation device design. Many devices attempt to address the problem of regaining knee flexion. Examples are U.S. Pat. No. 9,669,249 Range of Motion Improvement Device, U.S. Pat. No. 9,498,399 Therapeutic Knee Apparatus, U.S. Pat. No. 9,254,403 Joint Rehabilitation Strap, and U.S. Pat. No. 9,205,015B2 Linear Motion Device.

The inventor notes he is very blessed to have a father (now a retired orthopedic surgeon) who taught him an immense amount about the science of orthopedics over the inventor's decades of work in the medical and surgical products industry. The inventor's work has included many years working directly with patients and clinicians in the field of orthopedics and rehabilitation. In 2007, the inventor's father underwent knee replacement surgery and fabricated a unique design that was never shared with the public. Although the inventor was aware of the device and its uniqueness, the inventor did not take any action to develop the device until March 2017 when the inventor decided to modify the device and make several improvements, with the intention to bring the device to market. Since March 2017, the inventor has been pursuing this course full time and has used non-disclosure agreements to progress the course of establishing a manufacturing chain, and proving of the design and concept through consulting with a select few individuals, former knee surgery patients, and clinicians.

The inventor has been in the industry as a durable medical equipment provider and manufacturer representative for over 30 years. The inventor has worked with many of the major rehabilitation modalities that are used after knee replacement surgery. Over the years, the inventor has conversed with hundreds of patients on issues surrounding knee surgery and knee recovery. The inventor became very aware that gaining full flexion was, and still is, a continuing challenge for patients.

As a manufacturing representative, the inventor has represented total knee replacement implants and other knee surgery products in the operating room where the inventor interacted with surgeons and consulted significantly about the surgical procedures and rehabilitation/recovery issues including regaining maximum knee flexion. Furthermore, the inventor has read journal articles, attended conferences, and kept up on topics in knee rehabilitation, which confirmed the challenge of regaining full knee flexion.

Although knee surgery enjoys great overall success, today there are still the same problems as there were years ago. Not all patients are satisfied with their outcomes. That is largely a function of how much knee flexion, knee muscle strength, and control of pain and swelling is recovered after major knee surgery. Without strength and full knee flexion, many ordinarily easy tasks as mentioned above (e.g., navigating stairs, etc.) become very difficult or unachievable without aids of some type.

The methods and rehabilitation device described herein provide patients an easy effective tool to work on maximizing knee flexion, regaining knee muscle group strength, managing pain response, and with regular use can also favorably reduce and limit knee joint swelling.

SUMMARY

A method for inducing knee flexion described herein can be used to rehabilitate an injured knee. Rehabilitation of the injured knee involves extension and flexion of the joint. Extension and flexion are opposite movements. Extension is the action of straightening or the condition of straightening a joint. Extension increases an angle between body parts. Flexion is the action of bending or the condition of bending a joint. Flexion decreases an angle between body parts.

The method described herein includes securing a knee rehabilitation device to a leg, where the knee rehabilitation device includes a frame with a handle on a proximal end, a pad piece on a distal end, and a strap between the proximal end and the distal end. The method includes positioning the knee rehabilitation device on the leg so that the handle is above a knee on the leg, the pad piece rests on an ankle of the leg, and a portion of the leg is placed in the strap.

In one embodiment, the knee rehabilitation device can include a bend in a frame thereof, and the knee rehabilitation device is mounted on the leg so that the knee is aligned with the bend of the rehabilitation device. In one embodiment, the length of the frame may be adjustable to achieve the alignment, to thereby accommodate various leg lengths.

The method includes applying a first force to the handle in a first direction. The first direction is substantially parallel to the ground with a clockwise arc, and the second direction is opposite and parallel to the first direction. A user having the leg secured in the rehabilitation device may apply the first force.

The pad piece is actuated in response to the first force to move in a second direction which applies a second force to the ankle of the leg. The strap supports the portion of the leg on an opposite side of the rehabilitation device from the pad piece. The application of the first force and the second force cause bending of the knee of the leg in response to the first force and second force, thereby inducing flexion in the knee. In some embodiments, the musculature of the leg in the strap is in a non-contracted state such that the first force and second force induce further flexion of the knee.

In some embodiments, an amount of movement of the rehabilitation device correlates with an amount of flexion in the knee. For example, an angle formed between the frame bend and a longitudinal plane correlates with an angle of knee flexion. In some embodiments, the method can include measuring an angle of knee flexion, where the angle of knee flexion is at least about 30 degrees. Additionally, or alternatively, in some embodiments, the method can include measuring an angle of knee flexion between a longitudinal axis from the knee and another axis along the leg from a frame bend of the rehabilitation device to the ankle to obtain the angle of knee flexion, and calculating a range of knee flexion angles using the angle of knee flexion. In some examples, the range of knee flexion may be between about 30-160 degrees.

Physical therapy visits also are a key component in the recovery process following knee surgery or recovery from knee injury. Therapy sessions are expensive and when paid for by insurance there are a limited number of visits allowed. Due to the scheduling and travel logistics, physical therapy appointments can also be challenging for patients to get to on a regular basis.

Related specifically to regaining of knee flexion, part of the physical therapy session is the manual "hands on" therapy by the therapist, wherein the therapist bends the patient knee and forces the knee into as much flexion as possible. As this can cause considerable pain a trusting relationship between the patient and therapist is critical for the manual bending to be productive. Too much pain can cause a negative patient response which can slow down or prevent the progress of therapy. Patients may also have to see different therapists due to scheduling which can lessen consistency of care. The rehabilitation device allows the user (patient) exact control of the amount of force used to leverage knee flexion. The rehabilitation device also allows muscle strengthening, modulation of pain response, and management of swelling.

Directly related to gaining full knee flexion are methods for assisting patients in regaining knee muscle strength, also a key element in recovery following surgery or knee injury/condition. The rehabilitation device provides a unique way for patients to exercise and assist the re-strengthening progress of knee extensor (quadriceps) muscles through isometric active resistance, and knee flexor groups (hamstrings) through active assistance. These exercise techniques are described further herein.

There are a large number of products and designs of devices and techniques to assist with the rehabilitation of knee extensor and flexor muscle groups. They can be categorized generally into large machines with seating platforms and various components extending from the base, rope and pulley or cord techniques, elastic band techniques, electrical stimulation devices, exercises with or without cushions, and weights or other devices designed to provide resistance or assistance. In a comprehensive web search that included patented devices nothing has been found that approximates the rehabilitation device design and exact function in providing isometric and ergonomic resistance to the quadriceps during the quadriceps contraction technique, or in providing active assistance to the knee flexors (hamstrings muscle group) in an ergonomic manner. Examples of patents reviewed for quadriceps strengthening were U.S. Pat. Nos. 4,304,401, 2,855,199, and for flexor assisted strengthening were U.S. Pat. Nos. 5,509,894, and 5,582,579.

A search of devices treating knee joint area swelling came up with many devices similar to devices that treat pain including a number of different compression sleeves and types, cryotherapy, and combination of the above, but did not manifest a device for manually flexing the knee such as the rehabilitation device described herein.

DRAWINGS

FIG. 1 a front view of a knee rehabilitation device described herein.

DETAILED DESCRIPTION

A method for inducing knee flexion described herein that can be used to rehabilitate an injured knee. The method for inducing knee flexion described herein includes securing a knee rehabilitation device to a person's leg, the rehabilitation device includes a frame with a handle at a proximal end, a pad piece at a distal end, and a strap between the proximal end and the distal end. The method further includes positioning the knee rehabilitation device so that the handle is above a knee on the leg, with the pad piece resting on an ankle of the leg, and a portion of the leg between the knee and the ankle being supported in the strap. A first force is applied to the handle in a first direction, with the pad piece being actuated in response to the first force to move in a second direction which applies a second force to the ankle of the leg.

The knee rehabilitation device described herein is a portable, user-directed, manually operated device that can help a user gain knee flexion. The knee rehabilitation device can aid exercise in knee muscle groups, and the knee may be flexed and exercised in a natural ergonomic manner, thereby facilitating recovery. The knee rehabilitation device can provide immediate biofeedback to the user. Direct biofeedback allows the user to continually monitor and modulate pain level, which is a very important component of recovery. Frequent use and interaction with the knee rehabilitation device may reduce and limit knee swelling, which may aid in knee flexion.

Figure 1:
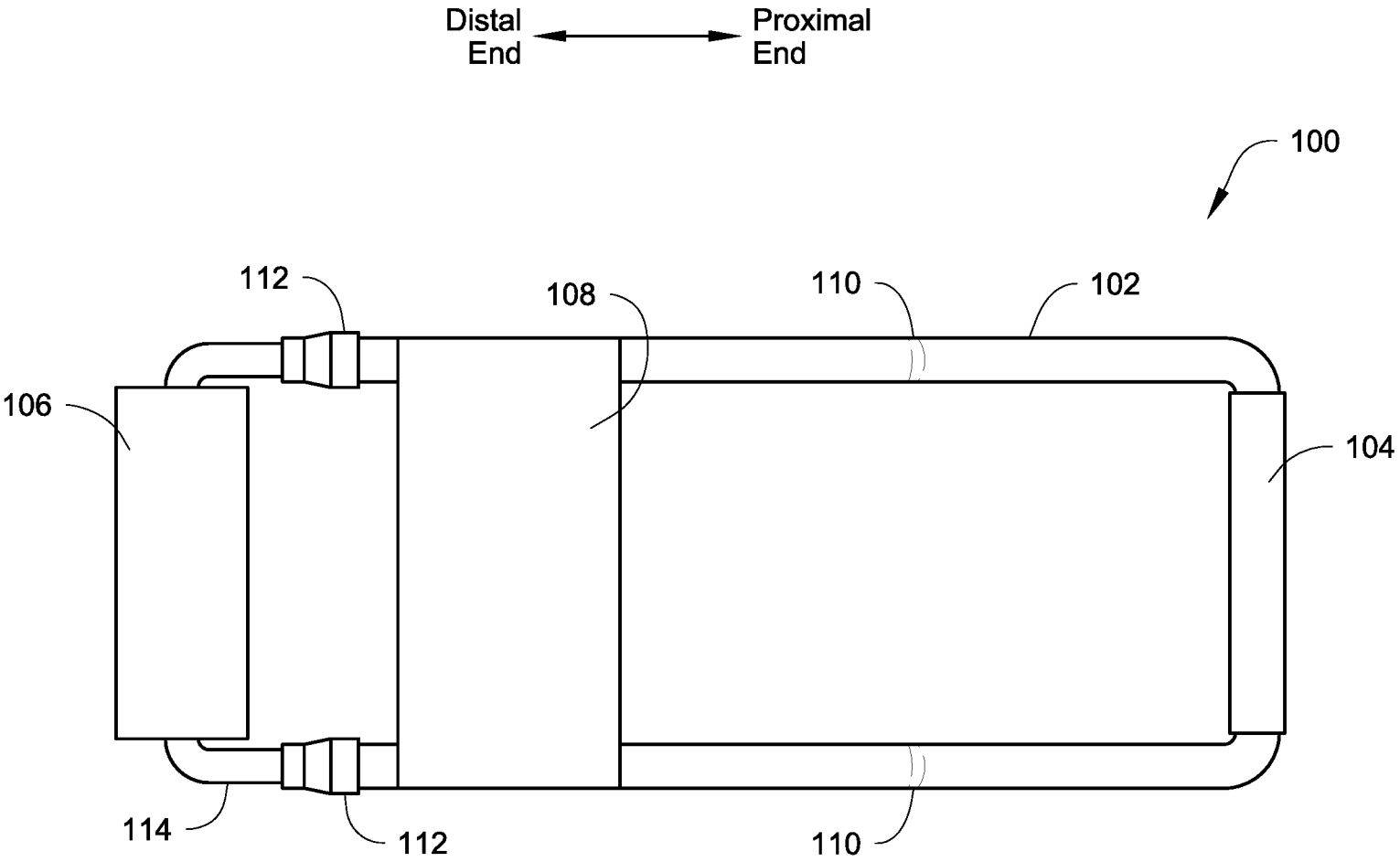
Figure 2:
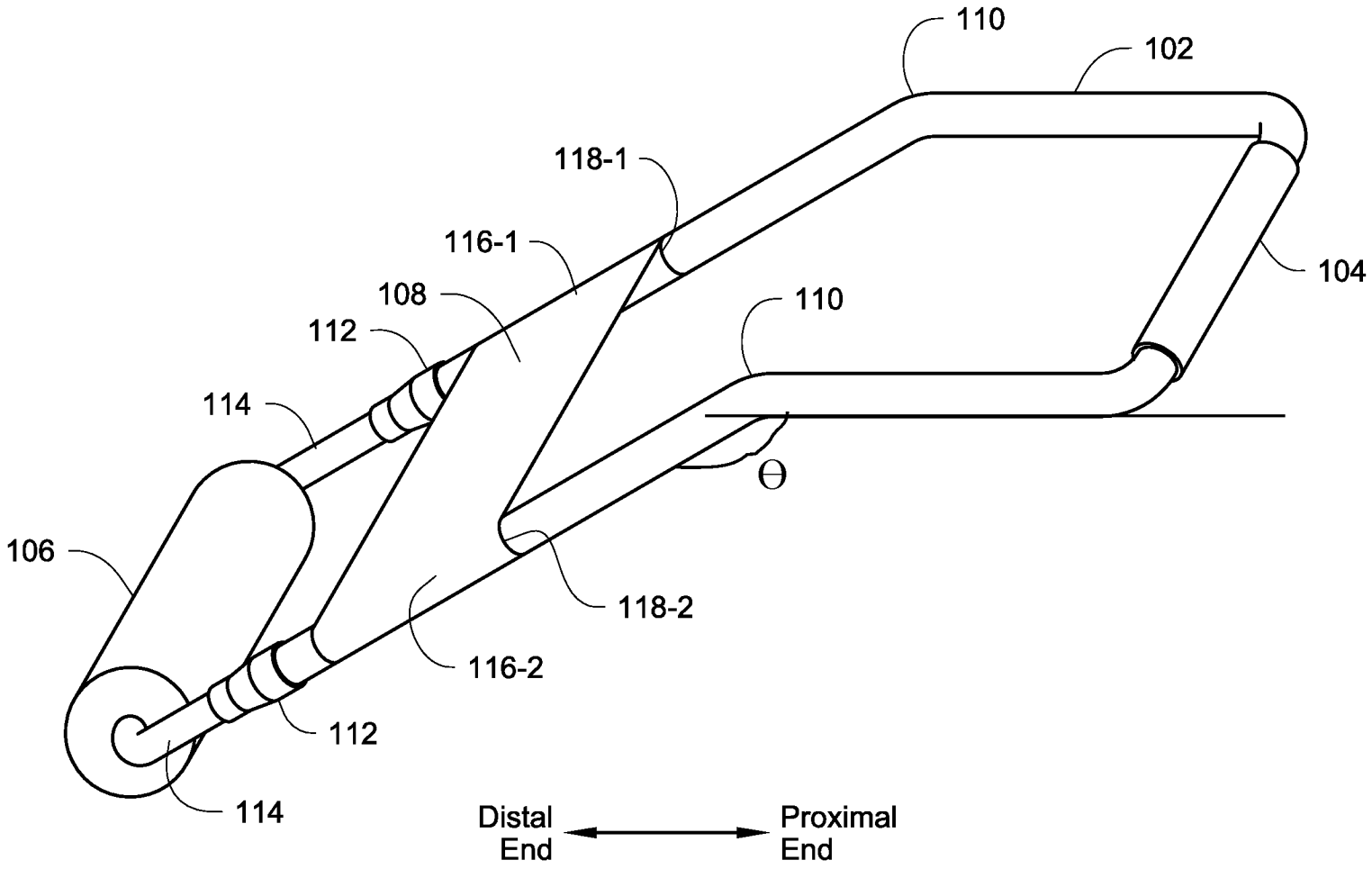
FIG. 2 illustrates a perspective view of the knee rehabilitation device of FIG. 1.

FIG. 1 illustrates a front view of a rehabilitation device 100, while FIG. 2 illustrates a perspective view of the rehabilitation device 100. Referring to FIG. 1 and FIG. 2, the rehabilitation device 100 includes a frame 102, a handle 104 at a proximal end of the frame 102, a pad piece 106 at a distal end of the frame 102, a strap 108, a frame bend 110, a clamp adjustor 112, and a frame component 114. Each element of the rehabilitation device 100 is discussed in detail as follows.

The frame 102 is made of a lightweight, tubular structure that is rigid. The frame 102 is structured to form a frame along a leg, as discussed further in FIG. 3. The handle 104 is located at the proximal end of the frame 102 while the pad piece 106 is located at the distal end of the frame 102. The handle 104 may include a soft grip portion disposed around the tubular frame structure for a hand to contact and grip the frame 102. The pad piece 106 is disposed about the tubular frame structure and is a cushioned mass that provides a soft contact between a user and the rehabilitation device 100. The pad piece 106 may include a soft bulky bolster that is designed to rest upon a lower portion of the leg. In some example, the pad piece 106 can include a scallop or contoured groove to center on the ankle. The pad piece 106 can allow comfortable leverage/pressure to be centered on the front (anterior) of the lower portion of the leg. As used herein, the lower portion of the leg can refer to an ankle, a foot, and/or a lower area of an anterior calf of the leg. For example, the pad piece 106 may rest upon the ankle on an anterior side of the leg and/or a foot. The pad piece 106 may have a larger circumference than the handle 104.

The strap 108 is located between the proximal end and the distal end of the frame 102. As shown in FIG. 2, a first piece 116-1 of the strap 108 connects to a first piece 118-1 of the frame 102, while a second piece 116-2 of the strap 108 connects to a second piece 118-2 of the frame 108. The strap 108 extends from one side of the frame 102 to another side of the frame 102 such that the strap 108 forms a surface between the frame 102. The strap 108 can be described as extending in a direction that is substantially transverse or perpendicular to the longitudinal axis of the frame 102, or in a direction that is substantially parallel to the pad piece 106, or substantially parallel to the handle 104. The strap 108 secures a portion of the leg in the rehabilitation device 100. The portion of the leg secured by the strap 108 is a posterior portion. For example, a posterior portion of the calf of the leg may be cradled by the strap 108 in the rehabilitation device 100.

The strap 108 may be made of a long, wide, non-elastic, thin material that does not impede knee flexion or deform when pressure is applied. In some examples, the strap 108 can have a closed sewn loop at each end so as to be pre-assembled and oriented correctly on the frame 102 to make application easier for a user and/or prevent loss of the strap 108. The strap 108 can be adjusted to different positions along the frame 102 to accommodate individual leg anatomy including, but not limited to leg girth, length, size, or the like.

Referring to FIG. 1 and FIG. 2, the frame bend 110 forms an angle θ (seen in FIG. 2) in the frame 102 that corresponds to a bend in the knee. The frame bend 110 is located above the strap 108 and below the handle 104 on the proximal end of the frame 102. In some embodiments, the angle θ may be between approximately 20-40 degrees. For example, the angle θ may be approximately 30 degrees.

The clamp adjustment 112 permits adjustments to the length of the frame 102. In the illustrated example, the clamp adjustment 112 is located below the strap 108 and above the pad piece 106. The clamp adjustment 112 connects a lower frame component 114 to an upper frame component of the frame 102. The lower frame component 114 can be telescoped within the upper frame component, with the clamp adjustment 112 being loosened to adjust the length of the frame 102 and tightened to fix the length. The lower frame component 114 can function similar to a trombone piece, such as sliding in and/or out of the upper frame component of the tubular frame 102. The lower frame component 114 may be extended or retracted to accommodate different leg lengths. The pad piece 106 is located on the frame component 114.

Figure 3:
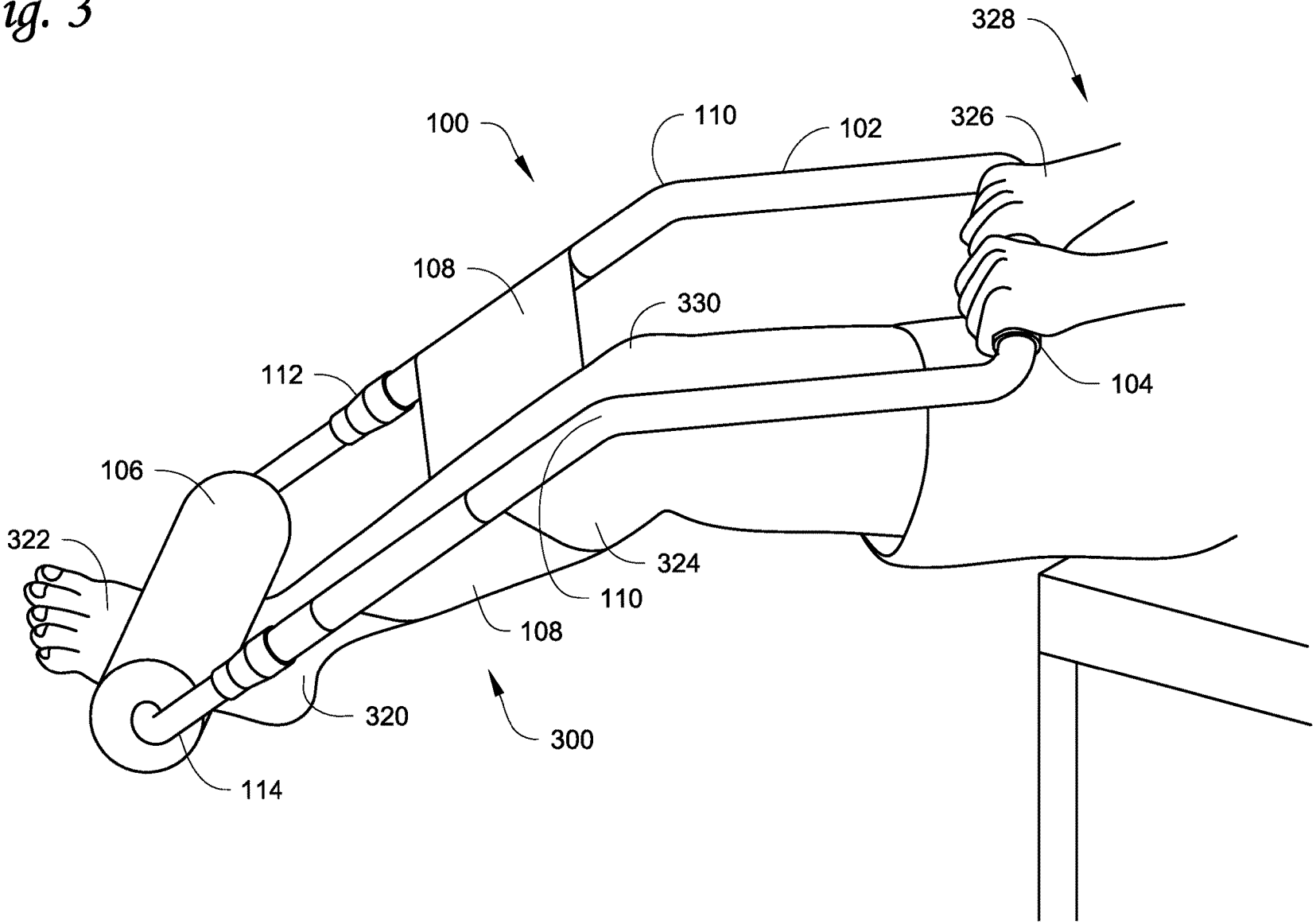
FIG. 3 illustrates a leg harnessed in the knee rehabilitation device of FIG. 2 for flexion.

FIG. 3 illustrates a leg 300 harnessed in the knee rehabilitation device of FIG. 1. The rehabilitation device 100 is structured accommodate the leg 300 of a user 328 to induce flexion of a knee 330 of the user 328. As shown in FIG. 3, when the knee rehabilitation device 100 is properly positioned on the leg 300, the pad piece 106 rests upon a lower portion of the leg 300, such as an anterior portion of the ankle 320 and/or anterior portion of a foot 322, while the strap 108 is behind the leg 300 supporting a posterior portion 324 of the leg 300, such as a calf, and the handle 104 may be grasped by a hand(s) 326 of the user 328. In some examples, the strap 108 can be adjusted to cradle more or less of the posterior portion 324 of the leg 300.

In some embodiments, securing the rehabilitation device 100 to the leg 300 of the user 328 can include positioning two areas of contact of the leg 300 in the rehabilitation device 100. The two areas of contact can include a posterior area and an anterior area. The posterior area can be the portion 324 of the leg 300 that can be placed in the strap 108, and the anterior area can be the ankle 320 upon which the pad piece 106 rests. In some embodiments, contact with the foot 322 or lower calf can be the anterior area that is in contact with the rehabilitation device 100.

As illustrated in FIG. 3, the knee 330 of the user 328 is aligned with the frame bend 110 of the rehabilitation device 100 so that the axis of bending of the knee joint extends through the bend 100. A length of the frame 102 can be adjusted to accommodate the length of the leg 300, such that the bend 110 in the frame 102 aligns with the knee 330. In some embodiments, the frame bend 110 can be aligned with the knee 330 such that an amount of movement of the rehabilitation device 100 can correlate with an amount of flexion in the knee 330. The frame bend 110 can allow the user 328 to bend the knee 330 by applying a force to move the frame 102 and lever the leg 300, thereby bending the knee 330, as discussed further herein.

The handle 104 of the rehabilitation device 100 can allow the user 328 to comfortably lever the frame 102 by holding on to the handle 104, lifting up and/or pushing outward with their hands 326 while using arm strength to help the knee 330 bend. This may also provide resistance or assistance when exercising knee muscle groups. Using the rehabilitation device 100 is most effective when the user 328 is sitting or in a semi-reclined position on a flat surface, such as a bed or a comfortable floor position, or from a chair in a position that does not restrict full knee bending.

Figure 4:
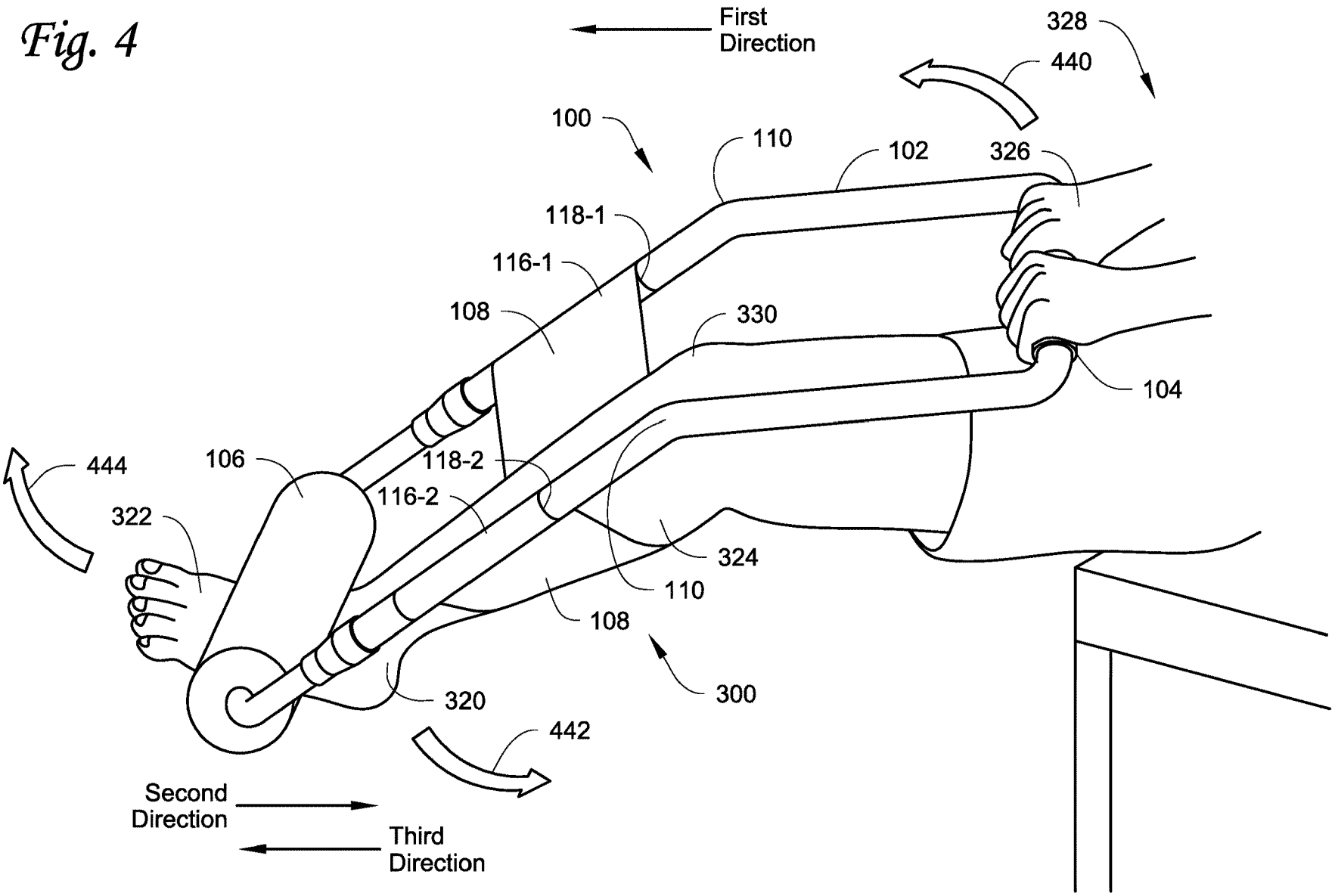
FIG. 4 illustrates movement of the leg in the knee rehabilitation device of FIG. 3 in the flexion direction.

FIG. 4 illustrates initial movement of the leg in the rehabilitation device of FIG. 3. As illustrated in FIG. 4, the user 328 of the rehabilitation device 100 can apply a first force 440 in a first direction to induce flexion of the knee 330. The first force 440 is a force that is generally along a longitudinal plane and substantially parallel to the ground with a small arc. The first force 440 is a force in a direction away from a body of the user 328.

A second resulting force 442 is then applied in response to the first force 440. The pad piece 106 is actuated in response to the first force 440 to move in a second direction which applies the second force 442 to the ankle 320 of the leg 300. The second force 442 is in a direction (also referred to as a flexion direction) opposite and generally parallel to the first force 440. For example, the first force 440 may be in a forward direction (e.g., away from the user 328), while the second force 442 may be in a backward direction (e.g., toward the user 328). The second force 442 acts upon the ankle 320 to move toward the upper leg (e.g., thigh, buttocks) of the user 328, thereby creating an angle of flexion.

The user 328 having the leg 300 secured in the rehabilitation device 100 may apply the first force 440, thereby creating a biofeedback loop. For example, the user 328 can apply the first force 440, actuating the pad piece 106 and applying the second force 442 to the ankle 322 of the user 328. The movement of the ankle 322 causing flexion of the knee 330. The user 328 will experience immediate biofeedback with respect to pain, swelling, and comfort level.

Movement of the leg 300 and/or muscle contraction may increase knee flexion. The user 328 may induce knee flexion by way of a passive or active assisted manner. A passive manner induces knee flexion without leg 300 muscle contraction. For example, the user 328 may implement a passive flexion in which the leg 300 muscles are not contracted while the hands 326 or arms (not shown) apply the first force 440 to the handle 104 to induce flexion in the knee 330. In other words, the leg 300 is passively being moved by the rehabilitation device 100.

In contrast, an active assisted manner induces knee flexion with leg 300 muscle contraction. For example the portion 324 (i.e., calf muscle) of the leg 300 in the strap 108 may be contracted while the user 328 applies the first force 440 to the handle 104 of the rehabilitation device 100. In some embodiments, the user 328 may apply the second force 442 to the ankle 322 to induce flexion of the knee 330. For example, the user 328 may activate muscles in the leg 300 to press against or together with the pad piece 106. In other words, the leg 300 is actively engaged with the movement of the rehabilitation device 100.

Accordingly, the user 328 may implement the rehabilitation device 100 for passive movement purposes and/or active muscle contraction. Both manners function to induce movement in the knee 330 for rehabilitation related to flexion.

Various exercises specific to muscle groups may further benefit knee flexion rehabilitation. Implementing the passive or active assisted movement(s) can be used in various exercises. In some examples, the user 328 may perform an isometric quadriceps exercise, which entails contracting the quadriceps (not illustrated) in the leg 300 to exert a third force 444 via the ankle 322 to the pad piece 106. The user 328 may resist the movement by applying the first force 440 to the handle 104 with their hands 326 and/or arms, inducing further flexion in the knee 330. Exercising the quadriceps muscle group will fatigue and relax the muscles, which may contribute to less muscle resistance in achieving maximum knee flexion.

Another exercise may consist of an assisted hamstrings strengthening exercise, which entails a user 328 contracting the hamstrings to exert a different force (e.g., a force away from the body) in the second direction against the strap 108, resulting in knee flexion. A user 328 may apply an opposite force (e.g., downward force) to the handle 104 with their hands 326 and arms. The exercise may assist knee flexion as part of the recovery and strengthening rehabilitation process.

Figure 5:
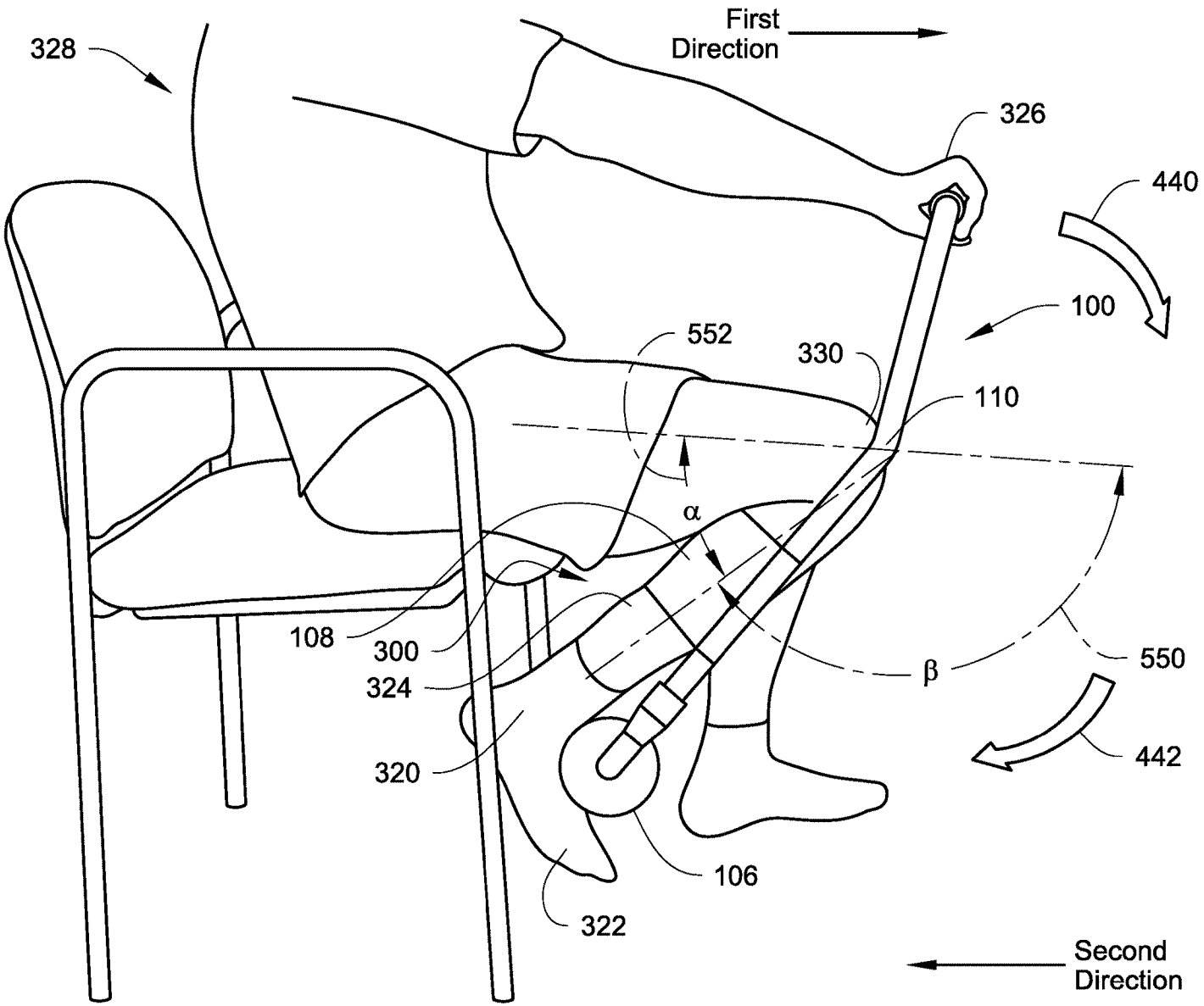
FIG. 5 illustrates the knee bent in flexion in accordance with the movement of FIG. 4.

FIG. 5 illustrates leveraging a knee to flexion in accordance with the movement of FIG. 4. An example of the method for inducing flexion of the knee 330 is described below.

The method includes securing the rehabilitation device 100 to the leg 300 of the user 328, as discussed above. The method includes arranging the rehabilitation device on the leg 300 such that the strap 108 contacts a posterior area (e.g., 324) of the leg 300 and the pad piece 106 contacts an anterior area (e.g., 322) of the leg 300. The strap 108 and pad piece 106 oppositely press upon the leg 300.

The method includes applying the first force 440 to the handle 104 in a direction away from the user 328. As shown in FIG. 5, the first force 440 is applied by the hands 326 and arms of the user 328. The pad piece 106 is actuated in response to the first force 440 to move in a second direction which applies the second force 442 to the ankle 320 of the leg 300, causing the knee 330 to bend. For example, the hands 326 may push the handle 104 of the rehabilitation device 100 away from the user 328, causing the pad piece 106 to press the ankle 322 toward the user 328, thereby inducing flexion of the knee 330.

Inducing flexion of the knee 330 forms an angle between the leg 300 (e.g., tibia) and body (e.g., femur) of the user 328. As illustrated in FIG. 5, an angle ($\alpha$) defines an angle of knee flexion 552, with the range of motion of the knee starting at a specific angle $\alpha$ and ending at a specific angle $\alpha$. In one embodiment, the range of motion can extend from an angle $\alpha$ of about 30 degrees to an angle $\alpha$ of about 160 degrees In some embodiments, the method can include determining the range of knee flexion by measuring the angle ($\beta$) 550 (which is 180 degrees minus a) The range of angles ($\beta$) 550 correlates to the bending of the knee joint.

It will be appreciated that the frame bend 110 having the angle θ may not correlate to the angle α of knee flexion 552. That is, while the frame bend 110 may be within a particular range (e.g., θ is approximately 20-40 degrees), the resulting angle α of knee flexion 552 can differ from the angle θ of the frame bend 110.

In some embodiments, the method includes ceasing application of the first force 440, causing the knee 330 to move to a baseline position, then applying the first force 440 again to induce flexion in the knee 330. Baseline position is a neutral position in which the leg 300 is bent to approximately 90 degrees. For example, baseline position can be when a user 328 is in a sitting position with the foot 322 on the ground. In such a position, the femur and tibia form a 90 degree angle.

The rehabilitation device 100 can increase flexion in the knee and/or aid recovery via at least one or more of the following three aspects: (1) increasing range of motion; (2) providing a biofeedback loop directly to the patient for pain management; and (3) increasing muscle strength. By lifting and then pushing out on the handle 104 of the rehabilitation device 100 using hand/arm strength the user 328 can cause the knee 330 to flex. Using the rehabilitation device 100 in the method described herein may reduce swelling in the knee 330 due to movement of fluid and blood flow. Using the rehabilitation device 100 as described herein allows the user 328 to control the force to leverage as much flexion of the knee as possible, thereby assisting in recovery and regaining flexion in the knee 330.

In some embodiments, when applying the first force 440 to the frame 102 by the hands 326 and arms to flex the knee 330, keeping the frame 102 straight and centered over the leg 300 requires a simple balanced ergonomic force applied by the arms and supported by the body core. This would be akin to a "steering" or tracking exercise. This "steering" keeps the force (e.g., 440) centered through the frame 102, through the ankle 320 and naturally centers the motion at the knee 330 with respect to the area of least resistance in the bending knee 330. Through manual patient directed force the knee 330 bending force (e.g., 440) is more natural and ergonomic than with a powered device such as a CPM, or with a device with outside mechanical force such as a static or dynamic splint, or with another individual applying the force (e.g., 440).

Additionally, or alternatively, as a separate exercise and also related to the ability to achieve full knee flexion, the user 328 can activate the knee 330 extensors (quadriceps or "quads") to contract the muscles and simultaneously hold down on the handle 104 of the frame 102 to provide active resistance. Through a number of repetitions, the quadriceps (quads) will become tired and more relaxed, and may then provide less resistance when returning focus to activating knee flexion. Additional functions as previously described include user modulation and control of pain and swelling in the knee 330 joint area.

When using the rehabilitation device 100 together with knee 330 muscle group exercise, the frame 102 must also be "steered" ergonomically to balance forces applied to the frame 102 between upper and lower body. The arms 326 can leverage assisted force to help with knee 330 hamstring muscle contraction, or the arms may leverage resistance force to exercise knee 330 quadriceps contraction. In either exercise an ergonomic and balanced relationship between upper and lower body muscle groups is facilitated.

Flexion of the knee using the rehabilitation device can provide a dynamic and tactile interaction between leg 300 movement and hands/arms of the user 328, which permits an immediate biofeedback response. Movement of the frame 102 correlates to movement of the knee 330, which can be associated with pain receptors in the knee 330. For example, moving the frame 102 a particular distance and/or applying a particular force (e.g., 440) induces flexion of the knee 330, and the resulting amount of movement may be painful to a user 328, thereby providing the user 328 immediate biofeedback. As such, inducing flexion of the knee 330 using a rehabilitation device 100 can allow a user 328 to monitor and modulate any knee pain by adjusting the amount of movement and/or the duration of force (e.g., 440) applied.

The rehabilitation device 100 provides the user 328 full awareness over the relationship between knee motion and pain. The rehabilitation device allows patients to flex their knee by grasping the handle 104, then by lifting and pushing on the handle 104 using arm strength only, or with leg 300 assistance, with direct biofeedback on the amount of pain that they are experiencing in/around the knee joint during motion. Being in total control of the motion allows the user 328 to manage and control pain. Being aware of the pain response with motion gives the user 328 control in managing pain as a maximum level of knee flexion is strived for.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method, comprising:

securing a knee rehabilitation device to a person's leg having a knee and an ankle, wherein the knee rehabilitation device includes a frame with proximal end, a distal end, a handle at the proximal end, a pad piece at the distal end, a strap located on the frame between the proximal end and the distal end, and a frame bend of between approximately 20-40 degrees between the proximal end and the distal end;

wherein the knee rehabilitation device is secured to the leg so that the handle is positioned above the knee with the frame bend aligned with an axis of bending of the knee, the pad piece rests on a front of the ankle, the strap is located behind the person's leg between the knee and the ankle, and a portion of the frame between the frame bend and the handle is bent toward an upper portion of the person's leg above the knee and a portion of the frame between the frame bend and the distal end is parallel to a lower portion of the person's leg below the knee; and applying a first force to the handle in a first direction, whereby the pad piece is actuated to move in a second, flexion direction thereby applying a second force to the ankle of the leg that causes the knee to bend thereby inducing flexion in the knee to a flexion angle.

2. The method of claim 1, wherein prior to applying the first force, the knee has a flexion angle that is approximately equal to 20-40 degrees.

3. The method of claim 1, further comprising inducing flexion in the knee from about 30 degrees to about 160 degrees.

4. The method of claim 1, wherein the first direction is generally parallel to ground, and the second direction is opposite and parallel to the first direction.

5. The method of claim 1, wherein the knee rehabilitation device is adjustable in length, and further comprising adjusting the length of the knee rehabilitation device to align the frame bend with the knee.

6. The method of claim 1, wherein the person applies the first force.

7. A method of inducing full knee flexion in a knee, comprising:

securing a knee rehabilitation device to a person's leg having a knee and an ankle, wherein the knee rehabilitation device includes a frame with proximal end, a distal end, a handle at the proximal end, a pad piece at the distal end, a strap located on the frame between the proximal end and the distal end, and a frame bend of between approximately 20-40 degrees between the proximal end and the distal end;

wherein the knee rehabilitation device is secured to the leg so that the handle is positioned above the knee with the frame bend aligned with an axis of bending of the knee, the pad piece rests on a front of the ankle, the strap is located behind the person's leg between the knee and the ankle, and a portion of the frame between the frame bend and the handle is bent toward an upper portion of the person's leg above the knee and a portion of the frame between the frame bend and the distal end is parallel to a lower portion of the person's leg below the knee; and applying a first force to the handle in a direction away from the user, wherein the first force is applied by a user, wherein the pad piece is actuated in response to the first force to move in a second direction which applies a second force to the ankle of the leg thereby causing the knee to bend to a flexion angle of between about 30 degrees to about 160 degrees.

* * * * *